US007558497B2

(12) United States Patent
Yamaki

(10) Patent No.: US 7,558,497 B2
(45) Date of Patent: Jul. 7, 2009

(54) IMAGE FORMING APPARATUS AND IMAGE FORMING METHOD

(75) Inventor: Hideo Yamaki, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 390 days.

(21) Appl. No.: 11/646,276

(22) Filed: Dec. 28, 2006

(65) Prior Publication Data

US 2007/0212125 A1 Sep. 13, 2007

(30) Foreign Application Priority Data

Mar. 8, 2006 (JP) ..... 2006-062170

(51) Int. Cl.
*G03G 15/16* (2006.01)
*G03G 15/01* (2006.01)

(52) U.S. Cl. ..... 399/66; 399/101; 399/302

(58) Field of Classification Search ..... 399/66, 399/101, 345, 302, 308, 313
See application file for complete search history.

(56) References Cited

U.S. PATENT DOCUMENTS 3,866,573 A * 2/1975 Szostak et al. ..... 399/313
5,870,650 A * 2/1999 Takahashi et al. ..... 399/101
6,915,097 B2 7/2005 Okamoto
2005/0254854 A1* 11/2005 Deguchi ..... 399/313
2006/0083538 A1* 4/2006 Terae et al. ..... 399/101

FOREIGN PATENT DOCUMENTS

| | | |
|---|---|---|
| CN | 1508637 A | 6/2004 |
| JP | 10-161434 | 6/1998 |
| JP | 2003-202729 | 7/2003 |
| JP | 2004-37916 | 2/2004 |

OTHER PUBLICATIONS

Office Action issued Jun. 27, 2008 in corresponding Chinese application No. 2006101567293 and translation thereof.

* cited by examiner

*Primary Examiner*—Susan S Lee
(74) *Attorney, Agent, or Firm*—Buchanan Ingersoll & Rooney PC

(57) ABSTRACT

An image forming apparatus increases a primary-transfer pressure contact force at the times of primarily transferring black color to a first sheet and yellow and black colors to a second sheet or subsequent sheets in order to prevent misalignment of colors. The apparatus also decreases the primary-transfer pressure contact force at the times of primarily transferring yellow, magenta and cyan colors to the first sheet, and magenta and cyan colors to the second sheet or subsequent sheets in order to prevent central blurs of colors.

8 Claims, 6 Drawing Sheets

IMAGE FORMING APPARATUS AND IMAGE FORMING METHOD

CROSS-REFERENCE TO RELATED APPLICATIONS

This application is based on the application No. 2006-062170 filed in Japan, the entire content of which is hereby incorporated by reference.

BACKGROUND OF THE INVENTION

The present invention relates to an image forming apparatus and an image forming method.

Conventionally, there has been an image forming apparatus of four-cycle-transfer type. The image forming apparatus is provided with a photoreceptor for developing a toner image from a development rack containing toner in four colors, an intermediate transfer belt onto which the toner image is primarily transferred from the photoreceptor, a secondary-transfer roller that secondarily transfers the toner image from the intermediate transfer belt onto recording material, and a cleaner unit that removes the toner remaining on the intermediate transfer belt. While the intermediate transfer belt makes four rounds, the toner image having each of the colors is sequentially transferred in each round from the photoreceptor onto the intermediate transfer belt (see JP 2004-37916 A).

In the conventional image forming apparatus, however, reduction in size of the apparatus has led to reduction in circumferential length of the intermediate transfer belt and in printing time of the apparatus. This has accordingly caused necessity for the secondary-transfer roller and the cleaner unit to be brought into pressure contact with or spaced apart from the intermediate transfer belt in the primary transfer.

The apparatus has a problem that each color is misaligned on the toner images which are primarily transferred onto the intermediate transfer belt. This is caused by a change in velocity of the intermediate transfer belt because tension of the intermediate transfer belt is changed when the secondary-transfer roller and the cleaner unit are pressure-contacted with the intermediate transfer belt during the primary transfer.

On the other hand, the change in velocity of the intermediate transfer belt can be prevented by pressurization against the intermediate transfer belt with use of increase in the primary-transfer pressure contact force exerted between the photoreceptor and the intermediate transfer belt. However, the increase in the primary-transfer pressure contact force may cause such a problem that a primary-transfer toner image has a central blur disadvantageously.

Herein, the central blur is caused by a status in which a central portion of a toner image (e.g., character, line or the like) resists being transferred from the photoreceptor onto the intermediate transfer belt in the primary transfer, and a status in which a central portion of a toner image (e.g., character, line or the like) resists being transferred from the intermediate transfer belt onto the recording material in the secondary transfer.

SUMMARY OF THE INVENTION

An object of the present invention is to provide an image forming apparatus that prevents both misalignment and central blurs of colors in the primary transfer.

In order to achieve the above-mentioned object, a first aspect of the present invention provides an image forming apparatus, comprising: a development unit containing toners in a plurality of colors, including a photoreceptor, and developing each of toner images, color by color, on the photoreceptor, an intermediate transporter onto which each of the toner images is primarily transferred from the development unit, color by color, by bringing the intermediate transporter into pressure contact with the photoreceptor of the development unit, a secondary-transfer unit placed so as to be capable of being brought into pressure contact with and being spaced apart from the intermediate transporter, where the toner images are secondarily transferred collectively from the intermediate transporter onto recording material by bringing the secondary-transfer unit into pressure contact with the intermediate transporter, a cleaner unit placed so as to be capable of being brought into pressure contact with and being spaced apart from the intermediate transporter, where the toners remaining on the intermediate transporter are removed by bringing the cleaner unit into pressure contact with the intermediate transporter, and a control unit controlling magnitude of a primary-transfer pressure contact force exerted between the photoreceptor and the intermediate transporter on basis of whether at least one of the secondary-transfer unit and the cleaner unit is in pressure contact with the intermediate transporter or not.

According to the image forming apparatus of the present invention, the control unit controls the magnitude of the primary-transfer pressure contact force exerted between the photoreceptor and the intermediate transporter based on whether at least one of the secondary-transfer unit and the cleaner unit is in pressure contact with the intermediate transporter or not. Thereby, variation in velocity of the intermediate transporter is prevented when at least one of the secondary-transfer unit and the cleaner unit is in pressure contact with the intermediate transporter. As the result, it is possible to reduce the misalignment of the toner images transferred primarily from the photoreceptor to the intermediate transporter. On the other hand, it is possible to prevent the pressure contact force from being excessively exerted between the photoreceptor and the intermediate transporter when the secondary-transfer unit and the cleaner unit are not in pressure contact with the intermediate transporter. Consequently, the central blurs are prevented in the toner images primarily transferred from the photoreceptor to the intermediate transporter.

Therefore, both the misalignment and central blurs of colors in the primary transfer are prevented in the image forming apparatus that performs the secondary transfer and/or cleaning of the intermediate transporter while performing the primary transfer.

The second aspect of the present invention provides an image forming method, comprising steps of: developing each of toner images on a photoreceptor, color by color, from among toners in a plurality of colors; primarily transferring each of the toner images from the photoreceptor onto an intermediate transporter, color by color, by bringing the intermediate transporter into pressure contact with the photoreceptor; secondarily transferring the toner images collectively from the intermediate transporter onto recording material by bringing a secondary-transfer unit into pressure contact with the intermediate transporter; and removing the toners remaining on the intermediate transporter by bringing a cleaner unit into pressure contact with the intermediate transporter, wherein at a time of primarily transferring each of the toner images from the photoreceptor onto the intermediate transporter so as to secondarily transfer the toner images onto the recording material, a primary-transfer pressure contact force exerted between the photoreceptor and the intermediate transporter, where the primary-transfer pressure contact force allows a toner image in one color to be primarily transferred from the photoreceptor onto the intermediate transporter when at least one of the secondary-transfer unit and the cleaner unit is in pressure contact with the intermediate transporter, is made greater than another primary-transfer pressure contact force exerted between the photoreceptor and the intermediate transporter, where another primary-transfer pressure contact force allows another toner image in another color to be primarily transferred from the photoreceptor onto the intermediate transporter when both the secondary-transfer unit and the cleaner unit are positioned apart from the intermediate transporter.

According to the image forming method of the present invention, the greater primary-transfer pressure contact force prevents variation in velocity of the intermediate transporter when at least one of the secondary-transfer unit and the cleaner unit is in pressure contact with the intermediate transporter. As the result, it becomes possible to reduce the misalignment of the toner images transferred primarily from the photoreceptor to the intermediate transporter. On the other hand, it is possible to reduce the pressure exerted on the toner during the primary transfer by the smaller primary-transfer pressure contact force when the secondary-transfer unit and the cleaner unit are spaced apart from the intermediate transporter. Therefore, the central blurs are prevented in the toner images primarily transferred.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
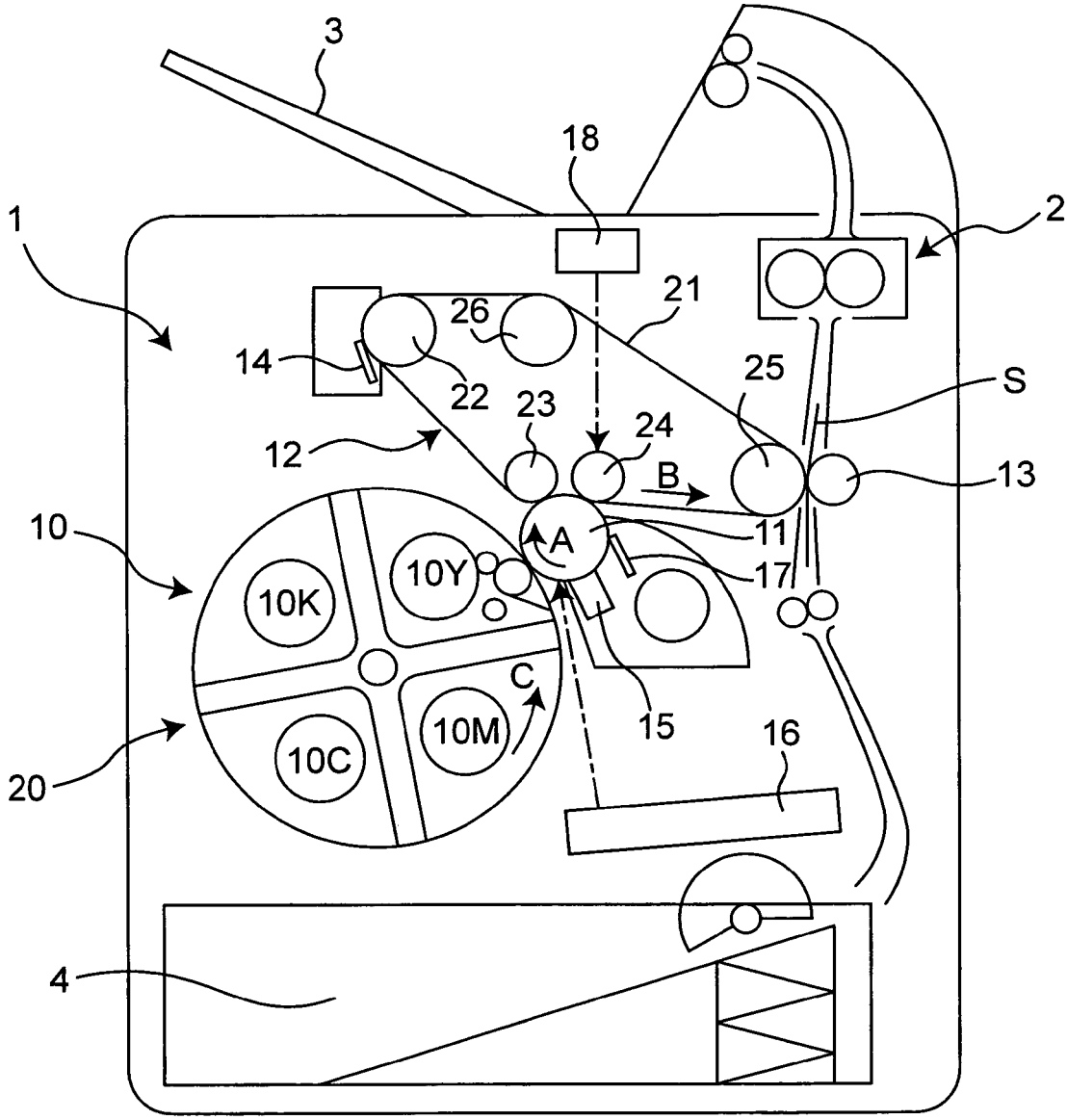
FIG. 1 is a schematic configuration view showing an image forming apparatus according to an embodiment of the invention.

Hereinbelow, the invention will be described in detail with reference to embodiments shown in the drawings.

FIG. 1 shows a schematic configuration of an image forming apparatus according to an embodiment of the present invention. The image forming apparatus has an imaging device 1 for depositing unfixed toner on recording material S to form an image, and a fixing device 2 for fusing and fixing the toner on the recording material S. The image forming apparatus is an electrophotographic four-color printer of four-cycle-transfer type.

The imaging device 1 has a development unit 20, an intermediate transporter 12, a secondary-transfer unit 13 and a cleaner unit 14. The development unit 20 contains toners in a plurality of colors, includes a photoreceptor 11, and develops toner images, color by color, on the photoreceptor 11. From the photoreceptor 11, the toner images are primarily transferred onto the intermediate transporter 12. The secondary-transfer unit 13 secondarily transfers the toner images from the intermediate transporter 12 onto the recording material S. The cleaner unit 14 removes the toner remaining on the intermediate transporter 12.

The recording material S is, for example, a sheet such as paper or OHP sheet. The toner is composed of material meltable by heat, e.g., resin, magnetic substance, or coloring matter. For example, the toners having a plurality of colors are those having e.g. four colors, that is, yellow (Y) toner, magenta (M) toner, cyan (C) toner, and black (K) toner.

The development unit 20 has a development rack 10 that contains the toners for four colors and the photoreceptor 11 that develops a toner image from the development rack 10.

The development rack 10 is shaped like a drum and has four spaces positioned at circumferential uniform intervals. In the four spaces are respectively placed a yellow cassette 10Y containing the yellow (Y) toner, a magenta cassette 10M containing the magenta (M) toner, a cyan cassette 10C containing the cyan (C) toner, and a black cassette 10K containing the black (K) toner.

The photoreceptor 11 is shaped like a drum and develops toner images on the intermediate transporter 12, color by color, whose color is from the four color toners contained in the development rack 10. Specifically, the photoreceptor 11 is provided with an electrification unit 15 for uniformly electrifying the photoreceptor 11 and an exposure unit 16 for effecting image exposure of the electrified photoreceptor 11. An electrostatic latent image, which has been formed by the exposure, is developed on the photoreceptor 11 by using each of the color toners contained in the development rack 10.

The photoreceptor 11 undergoes development by sequentially applying the yellow (Y) toner, the magenta (M) toner, the cyan (C) toner, and the black (K) toner from the development rack 10.

The photoreceptor 11 is provided with a cleaner unit 17. The cleaner unit 17 makes pressure contact with the photoreceptor 11 to remove the toner remaining on the photoreceptor 11 on a color-by-color basis.

Figure 2:
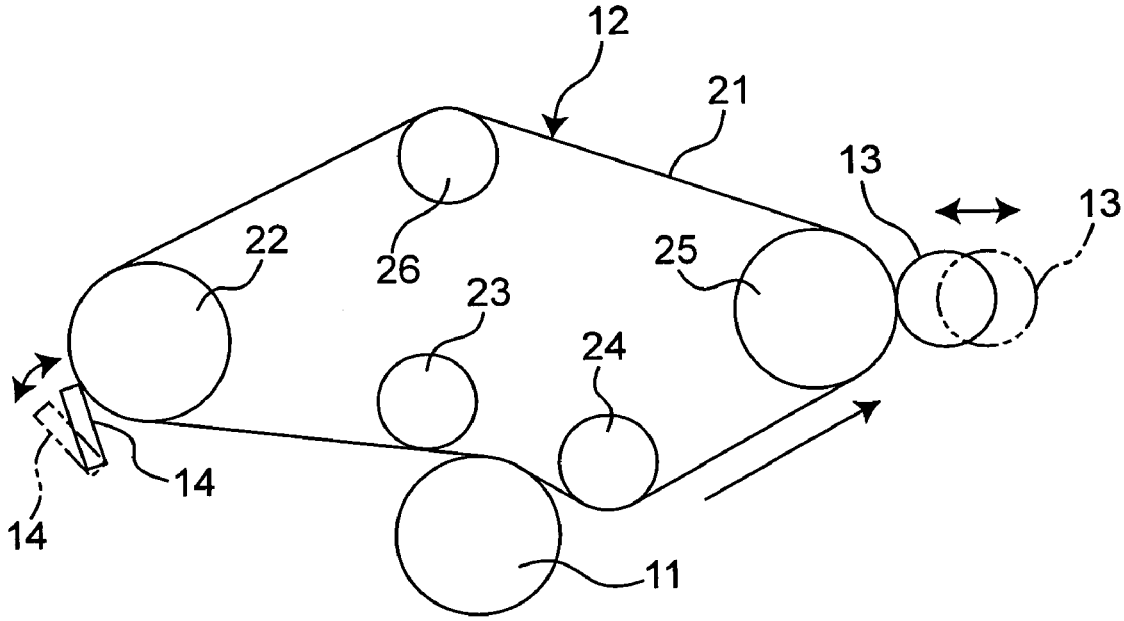
FIG. 2 is an enlarged view of an intermediate transporter of the image forming apparatus.

The intermediate transporter 12 is contacted with the photoreceptor 11 under pressure, so that the toner images are primarily transferred from the photoreceptor 11 onto the intermediate transporter 12 on the color-by-color basis. As shown in FIGS. 1 and 2, the intermediate transporter 12 has a belt 21, a cleaner-opposed roller 22, a primary-transfer wrapping roller 23, a primary-transfer roller 24, a secondary-transfer opposite roller 25, and a tension roller 26. These rollers are placed in order of mention circumferentially so as to support the belt 21 from inside thereof.

The photoreceptor 11 faces toward the primary-transfer wrapping roller 23 and the primary-transfer roller 24 and is in contact with the belt 21 therebetween. A pressure contact force of the belt 21 against the photoreceptor 11 is adjusted by setting the primary-transfer roller 24 close to or apart from the photoreceptor 11.

The secondary-transfer unit 13 is shaped like a roller. The secondary-transfer unit 13 is placed in such a way as to face the secondary-transfer opposite roller 25 so that the secondary-transfer unit 13 can bring into pressure contact with the belt 21 or can be spaced apart from the belt 21. The secondary-transfer unit 13 carries the recording material S together with the belt 21 while they are pinched. The secondary-transfer unit 13 collectively performs secondary transfer of the toner images from the intermediate transporter 12 onto the recording material S by pressure-contacting with the intermediate transporter 12.

The cleaner unit 14, which removes the toner on the intermediate transporter 12, is shaped like a blade. The cleaner unit 14 is placed to face the cleaner-opposed roller 22 in such a way that the cleaner unit 14 can be brought into pressure contact with and spaced apart from the belt 21. The cleaner unit 14 is brought into pressure contact with the belt 21 so as to remove the toner remaining on the belt 21.

The imaging device 1 has a control unit 18 that controls the magnitude of the primary-transfer pressure contact force between the photoreceptor 11 and the belt 21 on basis of whether at least one of the secondary-transfer unit 13 and the cleaner unit 14 is in pressure contact with the belt 21 or not.

Figure 3A:
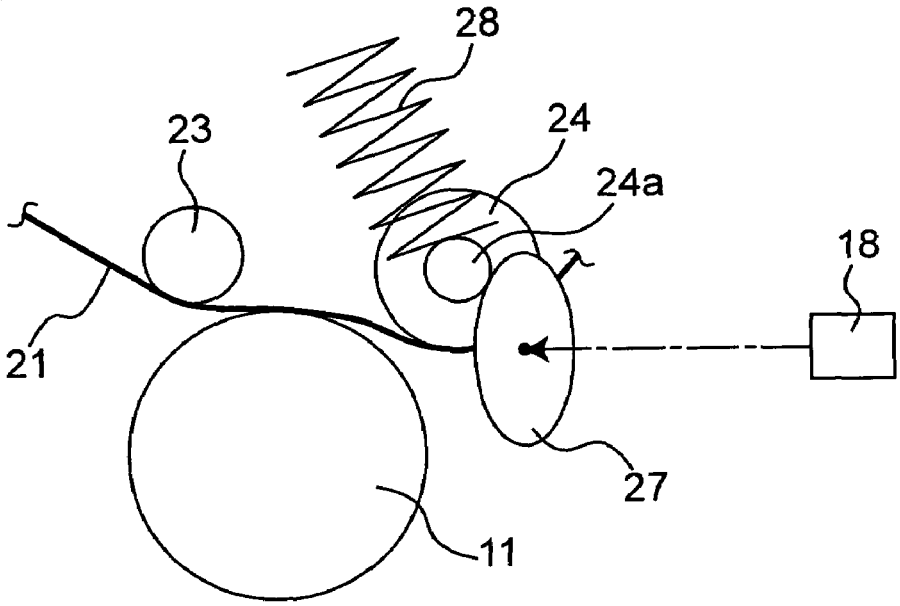
FIG. 3A is an operational explanatory view for illustrating a status in which a belt is contacted with a photoreceptor at high pressure by a primary-transfer roller.

As shown in FIG. 3A, on a shaft 24*a* of the primary-transfer roller 24 is mounted a compression spring 28 that all the time presses the primary-transfer roller 24 against the belt 21. A cam 27 is in contact with the shaft 24*a* of the primary-transfer roller 24 from a side opposite to the compression spring 28.

When the secondary-transfer unit 13 or the cleaner unit 14 (shown by solid lines in FIG. 2) is in pressure contact with the belt 21, the control unit 18 makes the cam 27 turn so that the primary-transfer roller 24 comes closer to the belt 21. Thereby, the primary-transfer pressure contact force between the photoreceptor 11 and the belt 21 is increased.

Figure 3B:
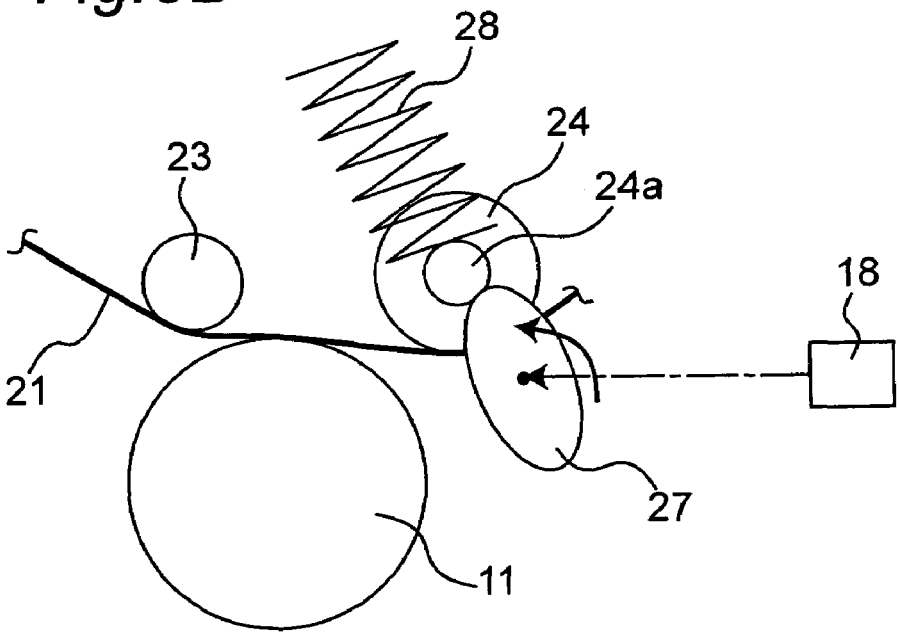
FIG. 3B is an operational explanatory view for illustrating a status in which the belt is contacted with the photoreceptor at low pressure by the primary-transfer roller.

When the secondary-transfer unit 13 and the cleaner unit 14 (as shown by imaginary lines in FIG. 2) are spaced apart from the belt 21 as shown in FIG. 3B, on the other hand, the control unit 18 makes the cam 27 turn so that the primary-transfer roller 24 gets away from the belt 21. Thereby, the primary-transfer pressure contact force between the photoreceptor 11 and the belt 21 is decreased.

Hereinbelow, operations of the image forming apparatus will be described.

As shown in FIG. 1, the development rack 10 rotates in a direction of an arrow C. At that time, the development rack 10 supplies the photoreceptor 11 with toners in order of yellow (Y), magenta (M), cyan (C), and black (K). The photoreceptor 11 rotates in a direction of an arrow A and develops each toner image on the color-by-color basis. The belt 21 is in pressure contact with the photoreceptor 11 and circulates in a direction of an arrow B. The toner images are primarily transferred on the color-by-color basis from the photoreceptor 11 onto the belt 21. That is, a toner image in each color is superposed on the belt 21 upon each rotation and, finally, the toner images in full color are formed after four rotations.

After that, the secondary-transfer unit 13 is brought into pressure contact with the belt 21, and the toner images (the toner images in full color) are secondarily transferred collectively from the belt 21 onto the recording material S.

Subsequently, the recording material S passes through the fixing device 2 positioned downstream in a carrier path of the recording material S, so that the toner images are thereby fixed onto the recording material S. Then, the recording material S is ejected onto an ejection tray 3.

The recording material S, which is stored in a cassette 4 at lowest position in the apparatus, is carried on sheet-by-sheet basis from the cassette 4 to the secondary-transfer unit 13.

Toner remaining on the photoreceptor 11 after the primary transfer is removed by the cleaner unit 17. Toner remaining on the belt 21 after the secondary transfer is removed by the cleaner unit 14.

Hereinbelow, a process will be described in which the colors are superposed in order of Y, M, C, and K through the primary transfer from the photoreceptor 11 onto the belt 21.

Figure 4:
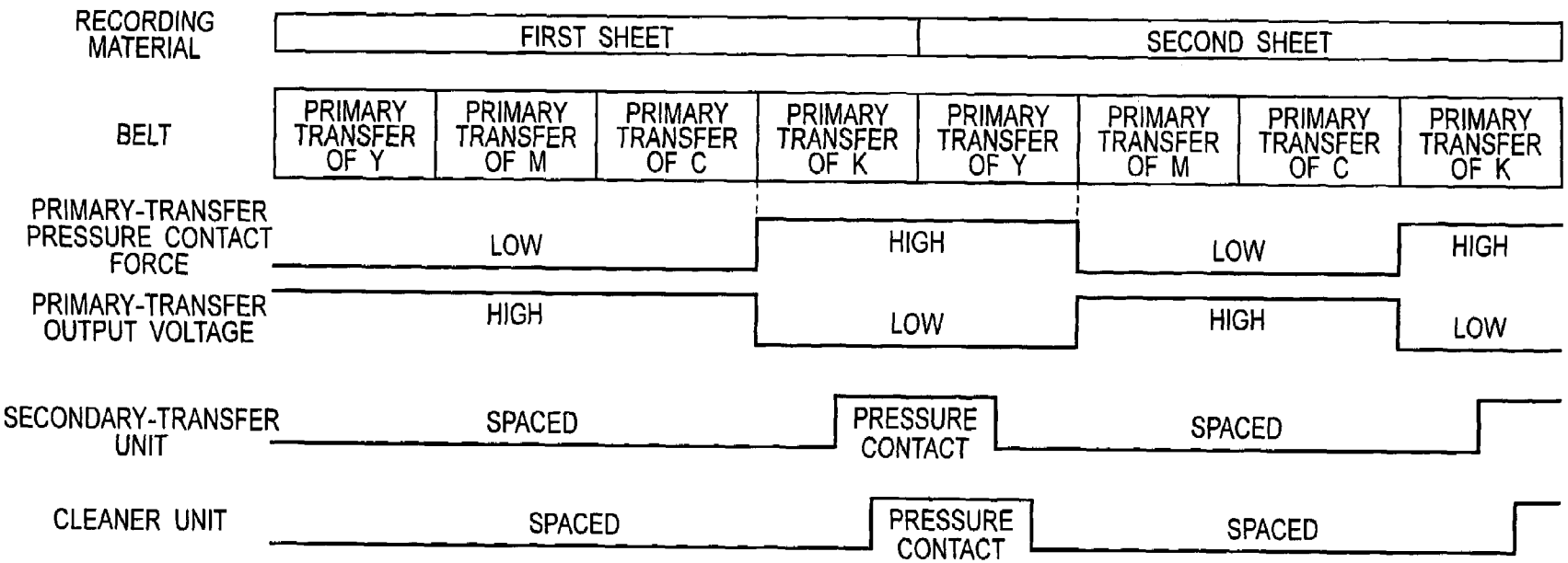
FIG. 4 is a timing chart for illustrating control performed by a control unit.

As shown in a timing chart of FIG. 4, at least one of the secondary-transfer unit 13 and the cleaner unit 14 is in pressure contact with the belt 21 at the times of the primary transfer of K to a first sheet of the recording material S and the primary transfer of Y, K to a second sheet of the recording material S. The secondary-transfer unit 13 and the cleaner unit 14 are positioned apart from the belt 21 at the times of the primary transfer of Y, M, C to the first sheet of the recording material S and the primary transfer of M, C to the second sheet of the recording material S. A third sheet or subsequent sheets of the recording material S is in the same state as the second sheet of the recording material S. Therefore, description thereof will be omitted.

The control unit 18 changes the primary-transfer pressure contact force when the image forming apparatus is in the state of the primary transfer from the photoreceptor 11 onto the belt 21 so as to conduct the secondary transfer from the belt 21 onto the recording material S on sheet-by-sheet basis. Specifically, a first primary-transfer pressure contact force, with which the toner image in one color is primarily transferred from the photoreceptor 11 onto the belt 21 when at least one of the secondary-transfer unit 13 and the cleaner unit 14 is in pressure contact with the belt 21, is made larger by the control unit 18 than a second primary-transfer pressure contact force, with which the toner image in another color is primarily transferred from the photoreceptor 11 onto the belt 21 when the secondary-transfer unit 13 and the cleaner unit 14 are positioned apart from the belt 21.

That is to say, the control unit 18 makes the primary-transfer pressure contact force for the primary transfer of K greater than the primary-transfer pressure contact force for the primary transfer of Y, M, C, for a first sheet. For a second sheet or subsequent sheets, the control unit 18 makes the primary-transfer pressure contact force for the primary transfer of Y, K greater than the primary-transfer pressure contact force for the primary transfer of M, C.

Thus, the velocity variation of the belt 21 can be prevented and the misalignment of the toner images transferred primarily can be reduced by the increase in the primary-transfer pressure contact force at the time when the secondary-transfer unit 13 or the cleaner unit 14 is in pressure contact with the belt 21. That is, the color misalignment is prevented by the increase in the primary-transfer pressure contact force at the time of the primary transfer of K to the first sheet and the primary transfer of Y, K to the second sheet or subsequent sheets.

When the secondary-transfer unit 13 and the cleaner unit 14 are positioned apart from the belt 21, on the other hand, the decrease in the primary-transfer pressure contact force results in decrease in the pressure on the toner in the primary transfer and prevents the central blurs in the primarily-transferred toner images. In other words, the central blurs of colors are prevented by the decrease in the primary-transfer pressure contact force at the times of the primary transfer of Y, M, C to the first sheet and the primary transfer of M, C to the second sheet or subsequent sheets.

The control unit 18 increases the primary-transfer pressure contact force when the toner image in black (K) is primarily transferred onto the belt 21, regardless of an ordinal number of the sheet of the recording material S. The central blurs in the black toner image, which does not coincide with the toner images in other colors, are prevented even though the primary-transfer pressure contact force is increased.

The control unit 18 increases the primary-transfer pressure contact force when the toner image in yellow (Y) is primarily transferred onto the belt 21 in the case where the recording material S is the second sheet or subsequent sheets. The central blurs in the yellow toner image, which does not coincide with the toner images in other colors, are prevented even though the primary-transfer pressure contact force is increased. At the time of the primary transfer of Y onto the first sheet, the control unit 18 does not control the primary-transfer pressure contact force. This is because there is no influence of pressure contact and isolation of the secondary-transfer unit 13 and the cleaner unit 14 with respect to the belt 21.

Briefly, the central blurs occur only with superposition of two colors. The central blurs of blue (M and C), red (M and Y), and green (C and Y) can be relieved by the decrease in the primary-transfer pressure contact force at the time of the primary transfer of M and C. In the case of one color, no central blur is generated even though the primary-transfer pressure contact force is increased at the time of the transfer of Y or K.

Figure 5A:
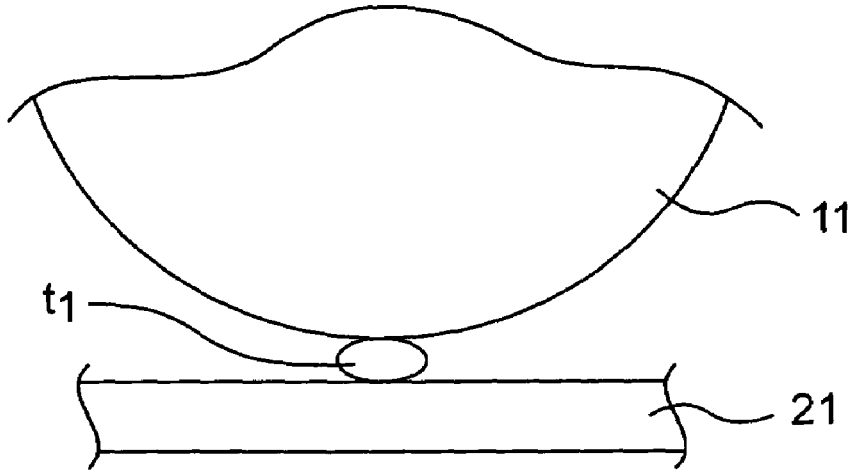
Fig.5A RELATED ART
FIG. 5A is an explanatory view for illustrating a pressure contact status of toner in the case where one-color toner is used.
Figure 5B:
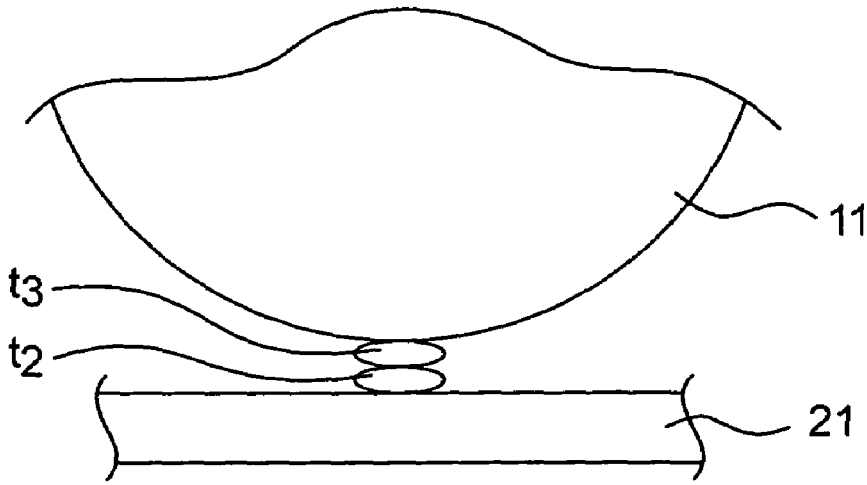
Fig.5B RELATED ART
FIG. 5B is an explanatory view for illustrating a pressure contact status of toner in the case where two-color toners are used in pile.

More specifically, when toner $t_1$ in only one color (Y, K) is transferred from the photoreceptor 11 onto the belt 21, as shown in FIG. 5A, the pressure contact force exerted on the toner $t_1$ is small, so that the central blurs of the toner $t_1$ are prevented. On the other hand, when toner $t_2$ in one color (Y, M) previously transferred and, thereafter, toner $t_3$ in another color (M, C) are transferred from the photoreceptor 11 onto the belt 21, as shown in FIG. 5B, the pressure contact force exerted on the toner $t_2$, $t_3$ in two colors is increased, so that the central blurs may be generated in the case of the two color toners $t_2$, $t_3$.

Thus, the image forming apparatus performs the primary transfer while performing the secondary transfer and cleaning of the belt 21, and prevents both the color misalignment and central blurs in the primary transfer.

With respect to a voltage applied to between the photoreceptor 11 and the primary-transfer roller 24 so as to primarily transfer the toner images from the photoreceptor 11 onto the belt 21, the control unit 18 controls the voltage for the primary transfer of the toner image in one color smaller than the voltage for the primary transfer of the toner image in another color.

Specifically, the control unit 18 makes the output voltage for the primary transfer of K smaller than the output voltage for the primary transfer of Y, M, C, for the first sheet. For the second sheet or subsequent sheets, the control unit 18 makes the output voltage for the primary transfer of Y, K smaller than the output voltage for the primary transfer of M, C.

Thus, when the primary-transfer pressure contact force is increased, a constant current can be passed between the photoreceptor 11 and the belt 21 by decreasing the output voltage for the primary transfer.

Specifically, when the primary-transfer pressure contact force is increased, a distance between the photoreceptor 11 and the primary-transfer roller 24 is decreased. Thereby, a contact area between the photoreceptor 11 and the belt 21 is increased, so that a resistance between the photoreceptor 11 and the primary-transfer roller 24 is decreased. Thus, a constant current can be passed therebetween by decreasing the output voltage.

When the primary-transfer pressure contact force is decreased, the primary-transfer roller 24 gets far away from the photoreceptor 11. Therefore, the contact area between the photoreceptor 11 and the belt 21 is decreased, so that the resistance between the photoreceptor 11 and the primary-transfer roller 24 is increased. Thus, a constant current can be passed by increasing the output voltage.

In the case where the primary-transfer pressure contact force is low, the output voltage is 1 kV for instance. In the case where the primary-transfer pressure contact force is high, the output voltage is decreased by the order of 5 to 15% up to 0.9 kV for example.

The control unit 18 may control the magnitude of the primary-transfer pressure contact force only under imaging conditions prone to cause the central blurs.

Herein, the imaging conditions prone to cause the central blurs are defined as conditions under which the central blurs are prone to occur in the primary transfer and the secondary transfer, for example, a condition during an endurance operation or a half-speed operation or under a high-humidity environment.

Thus, the central blurs can be prevented only under the imaging conditions prone to cause the central blurs where the control unit 18 controls the magnitude of the primary-transfer pressure contact force only under the imaging conditions prone to cause the central blurs. Under such a condition that the central blurs hardly occurs, on the other hand, the magnitude of the primary-transfer pressure contact force is not controlled, so that unnecessary control can be omitted.

Figure 6:
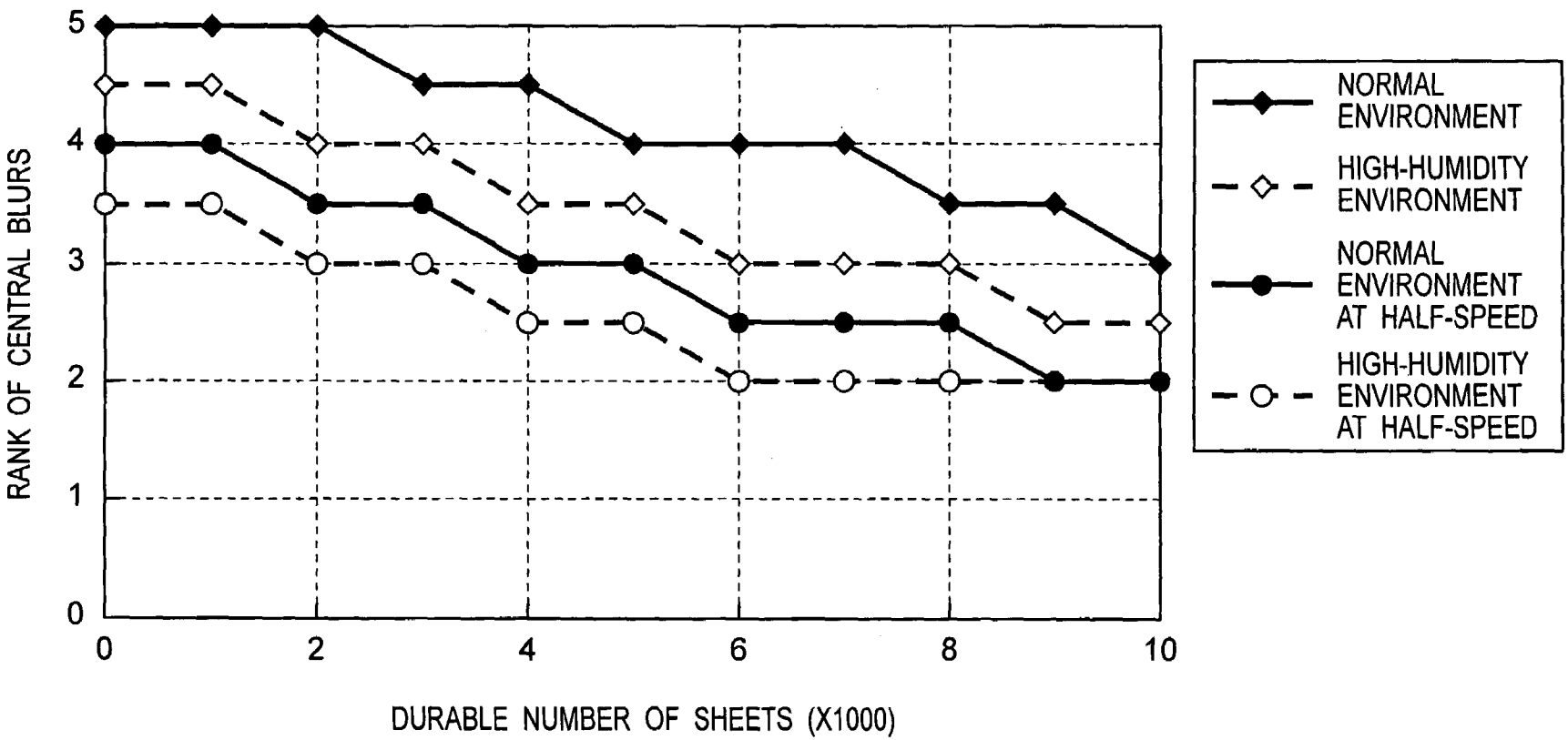
Fig.6 RELATED ART
FIG. 6 is a transition graph of central blurs in a conventional image forming apparatus.

FIG. 6 shows transition graphs of central blurs, as a comparative example, in the case where a conventional image forming apparatus is used. This image forming apparatus is of a type that cannot be replenished with toner. An axis of abscissa represents the number of used sheets of recording material. An axis of ordinate represents ranks or degrees of central blurs. The larger value in the ranks of central blurs indicates the better quality of the image forming apparatus where it is harder for the central blurs to occur in recording material. The image forming apparatus is acceptable at the value of 3.5 or more in the ranks of central blurs.

As seen from FIG. 6, the rank of central blurs exhibits a trend of degradation when more than 9000 sheets of paper are used under the normal environment. Under high-humidity environment, the rank of central blurs exhibits the trend of degradation when more than 5000 sheets of paper are used.

In the case of a half-speed operation under the normal environment, the rank of central blurs exhibits the trend of degradation when more than 3000 sheets of paper are used. In the case of the half-speed operation under the high-humidity environment, the rank of central blurs exhibits the trend of degradation when more than 1000 sheets of paper are used. Herein, a "half speed" is defined as a half of the normal velocity of the recording material or less around the half, which half speed is used when employing paper sheets for OHP (overhead projector), cardboards or postcards requiring a long fixation time.

The image forming apparatus according to the present invention makes it possible to prevent the central blurs by decreasing the primary-transfer pressure contact force with use of the control unit 18, wherein the central blurs are generated in the primary transfer and the secondary transfer when the apparatus is used for a long period of time, under high-humidity environment or at the half speed.

The control unit 18 can make smaller a first primary-transfer pressure contact force in the state (referred to as "monochrome mode") that only black toner has been selected for use from among the four color toners than a second primary-transfer pressure contact force in the state (referred to as "color mode") that two or more color toners has been selected for use from among the four color toners, wherein at least one of the secondary-transfer unit 13 and the cleaner unit 14 is in pressure contact with the belt 21.

Thereby, the central blurs in the primary transfer can be prevented more satisfactorily in the monochrome mode than in the color mode.

Alternatively, the primary-transfer pressure contact force in the monochrome mode may be made larger than the primary-transfer pressure contact force in the color mode, so that twist of the belt 21 can be prevented and satisfactory images can be obtained.

The invention is not limited to the embodiment described above. For instance, a transfer roller may be used instead of the belt 21. Instead of the one photoreceptor 11, a plurality of photoreceptors may be provided on the development rack 10 individually on the color-by-color basis.

The positional relation between the photoreceptor 11 and the primary-transfer roller 24 is not limited to the embodiment described above. For example, the primary-transfer wrapping roller 23 is omitted, and the photoreceptor 11 may directly be pressed by the primary-transfer roller 24.

As a mechanism that makes the primary-transfer roller 24 close to or away from the photoreceptor 11, a rack-and-pinion system or the like may be used instead of the cam system of the embodiment described above.

The color order of the toners supplied from the development rack 10 is not necessarily YMCK.

The image forming apparatus may be any of a monochrome/color copier, a printer, a facsimile machine, a compound machine of those, or the like.

The invention being thus described, it will be obvious that the invention may be varied in many ways. Such variations are not be regarded as a departure from the spirit and scope of the invention, and all such modifications as would be obvious to one skilled in the art are intended to be included within the scope of the following claims.

What is claimed is:

1. An image forming apparatus, comprising:

a development unit containing toners in a plurality of colors, including a photoreceptor, and developing each of toner images, color by color, on the photoreceptor, an intermediate transporter onto which each of the toner images is primarily transferred from the development unit, color by color, by bringing the intermediate transporter into pressure contact with the photoreceptor of the development unit, a secondary-transfer unit placed so as to be capable of being brought into pressure contact with and being spaced apart from the intermediate transporter, where the toner images are secondarily transferred collectively from the intermediate transporter onto recording material by bringing the secondary-transfer unit into pressure contact with the intermediate transporter, a cleaner unit placed so as to be capable of being brought into pressure contact with and being spaced apart from the intermediate transporter, where the toners remaining on the intermediate transporter are removed by bringing the cleaner unit into pressure contact with the intermediate transporter, and a control unit controlling magnitude of a primary-transfer pressure contact force exerted between the photoreceptor and the intermediate transporter on basis of whether at least one of the secondary-transfer unit and the cleaner unit is in pressure contact with the intermediate transporter or not.

2. The image forming apparatus as set forth in claim 1, wherein at a time of primarily transferring each of the toner images from the photoreceptor onto the intermediate transporter so as to secondarily transfer the toner images onto the recording material, the control unit makes greater the primary-transfer pressure contact force by which a toner image in one color is primarily transferred from the photoreceptor onto the intermediate transporter when at least one of the secondary-transfer unit and the cleaner unit is in pressure contact with the intermediate transporter than the primary-transfer pressure contact force by which another toner image in another color is primarily transferred from the photoreceptor onto the intermediate transporter when the secondary-transfer unit and the cleaner unit are positioned apart from the intermediate transporter.

3. The image forming apparatus as set forth in claim 2, wherein a toner image in black among the plurality of colors is primarily transferred onto the intermediate transporter finally, at least one of the secondary-transfer unit and the cleaner unit is in pressure contact with the intermediate transporter when the toner image in black is primarily transferred onto the intermediate transporter, and the control unit makes greater the primary-transfer pressure contact force when the toner image in black is primarily transferred onto the intermediate transporter.

4. The image forming apparatus as set forth in claim 2, wherein at a time of primarily transferring each of the toner images from the photoreceptor onto the intermediate transporter so as to secondarily transfer the toner images onto a second sheet or subsequent sheet of the recording material, at least one of the secondary-transfer unit and the cleaner unit is in pressure contact with the intermediate transporter when a toner image in a first color among the plurality of colors is primarily transferred onto the intermediate transporter, the first color being primarily transferred onto the intermediate transporter initially, and the control unit makes greater the primary-transfer pressure contact force when the toner image in the first color is primarily transferred onto the intermediate transporter.

5. The image forming apparatus as set forth in claim 2, wherein the control unit controls the magnitude of the primary-transfer pressure contact force only under an imaging condition prone to cause a central blur.

6. The image forming apparatus as set forth in claim 1, wherein the control unit makes smaller the primary-transfer pressure contact force at a time of using only the toner in black among the plurality of colors when at least one of the secondary-transfer unit and the cleaner unit is in pressure contact with the intermediate transporter than the primary-transfer pressure contact force at a time of using each of toners in two or more colors among the plurality of colors when at least one of the secondary-transfer unit and the cleaner unit is in pressure contact with the intermediate transporter.

7. The image forming apparatus as set forth in claim 2, wherein the control unit makes smaller a voltage applied to between the photoreceptor and the intermediate transporter for primarily transferring the toner image in one color from the photoreceptor onto the intermediate transporter than the voltage for primarily transferring each of the toner images in other colors.

8. The image forming method, comprising steps of:

developing each of toner images on a photoreceptor, color by color, from among toners in a plurality of colors;

primarily transferring each of the toner images from the photoreceptor onto an intermediate transporter, color by color, by bringing the intermediate transporter into pressure contact with the photoreceptor;

secondarily transferring the toner images collectively from the intermediate transporter onto recording material by bringing a secondary-transfer unit into pressure contact with the intermediate transporter; and removing the toners remaining on the intermediate transporter by bringing a cleaner unit into pressure contact with the intermediate transporter, wherein at a time of primarily transferring each of the toner images from the photoreceptor onto the intermediate transporter so as to secondarily transfer the toner images onto the recording material, a primary-transfer pressure contact force exerted between the photoreceptor and the intermediate transporter, where the primary-transfer pressure contact force allows a toner image in one color to be primarily transferred from the photoreceptor onto the intermediate transporter when at least one of the secondary-transfer unit and the cleaner unit is in pressure contact with the intermediate transporter, is made greater than another primary-transfer pressure contact force exerted between the photoreceptor and the intermediate transporter, where another primary-transfer pressure contact force allows another toner image in another color to be primarily transferred from the photoreceptor onto the intermediate transporter when both the secondary-transfer unit and the cleaner unit are positioned apart from the intermediate transporter.

* * * * *